US006222495B1

(12) United States Patent
Cook et al.

(10) Patent No.: US 6,222,495 B1
(45) Date of Patent: Apr. 24, 2001

(54) MULTI-BEAM ANTENNA

(75) Inventors: Scott J. Cook, Garner; Bruce W. Barratt, Selma, both of NC (US)

(73) Assignee: Channel Master LLC, Smithfield, NC (US)

( * ) Notice: Subject to any disclaimer, the term of this patent is extended or adjusted under 35 U.S.C. 154(b) by 0 days.

(21) Appl. No.: 09/513,787

(22) Filed: Feb. 25, 2000

(51) Int. Cl.[7] ..... H01Q 19/12
(52) U.S. Cl. ..... 343/840; 343/832
(58) Field of Search ..... 343/781 R, 832, 343/840, 912, DIG. 2; 351/212, 247; 356/124, 125, 127; H01Q 15/00, 13/00, 19/12

(56) References Cited

U.S. PATENT DOCUMENTS

| | | | | |
|---|---|---|---|---|
| 4,603,334 | | 7/1986 | Mizuguchi et al. | 343/779 |
| 4,792,808 | | 12/1988 | Hildebrand | 343/853 |
| 4,811,029 | | 3/1989 | Nomoto | 343/779 |
| 4,855,751 | | 8/1989 | Ingerson | 343/779 |
| 5,140,337 | | 8/1992 | Rappaport | 343/840 |
| 5,164,750 | * | 11/1992 | Adachi | 351/212 |
| 5,434,586 | | 7/1995 | Kinoshita et al. | 343/840 |
| 5,477,393 | * | 12/1995 | Sasaki et al. | 359/846 |
| 5,686,923 | | 11/1997 | Schaller | 342/352 |
| 5,825,476 | * | 10/1998 | Abitol et al. | 356/124 |
| 6,018,424 | * | 1/2000 | Morgan et al. | 359/708 |
| 6,032,377 | * | 3/2000 | Ichikawa et al. | 33/554 |

OTHER PUBLICATIONS

Naito, Izuru, et al., Electronics and communications in Japan, Part 1, vol. 78, No. 6, pp. 68, 69, 75–81 (1995).
e*star, Direct–To–Home Satellite Antenna Brochure received by Channel Master via facsimile on Mar. 10, 1998.
Schematic Diagram of Direct–To–Home Satellite Antenna Manufactured by e*, Jun. 16, 1998.
Johnson et al., Antenna Engineering Handbook, 2$^{nd}$ Ed., Chapter 17 pp. 41–45 (1984).

* cited by examiner

*Primary Examiner*—Tho Phan
(74) *Attorney, Agent, or Firm*—Darby & Darby

(57) ABSTRACT

A shaped offset parabolic antenna is disclosed which provides improved gain when receiving satellite broadcasts from geosynchronous transmission sources spaced substantially 10 degrees apart. The surface of the reflector is defined by a Zernike expansion mapped to a unit circle. The values of the parameters of the Zernike expansion are selected to provide a shaped reflector surface which focuses beams from the three separate sources onto three focal points such that the gain of the antenna is maximized. A peak beam gain for an offset beam of substantially 33.9 dBi has been achieved.

7 Claims, 6 Drawing Sheets

MULTI-BEAM ANTENNA

FIELD OF THE INVENTION

This invention is related to a specially shaped multi-beam antenna to provide maximum gain from a fixed size ground-based reflector while communicating with multiple satellites at predefined locations.

BACKGROUND OF THE INVENTION

Conventional television delivery services have relied primarily upon cable delivery systems to supply a large number of television channels to consumers. A drawback to cable delivery systems is the high cost of the physical infrastructure. In particular, transmission cables must be routed to every household to which the television services are offered. Another drawback is the physical limitations on the number of channels which can be carried through the cable.

An alternative to cable delivery systems is the use of satellite receivers. Early satellite systems used a large dish antenna which was directed to one of several geosynchronous television relay satellites. Such systems arc expensive and the size of the dish required limits where the systems can be used.

More recently, direct broadcast televisions systems using small parabolic receiving dishes, i.e., on the order of three feet in diameter or less, have become popular. Coupled with improvements in receiving electronics and the use of dedicated satellite systems, these types of systems are inexpensive enough to compete with established cable delivery systems and are superior in many locations where a cable infrastructure has not been completed.

However, conventional satellite-based direct-broadcast television systems suffer from bandwidth limitations which force the content providers to limit the number of stations which are provided to the consumer. Although the limitations are not typically as severe as those in cable-based systems, market pressures are forcing content suppliers to offer more programs than can be carried on a single satellite. For example, while satellite television providers have been recently granted the right to carry local television signals, many systems do not have the excess capacity to include these additional signals. In addition, reliability considerations caution against using only a single satellite for delivery since a failure of the satellite will shut down the entire system until the fault is resolved.

In response to these factors, direct broadcast television systems which use multiple satellites are presently contemplated. In a particular system, a constellation of three geosynchronous satellites is planned, wherein the satellites are spaced at ten-degree intervals. The use of multiple satellites complicates the reception of the broadcast signals because the antenna can only be directed towards one satellite. Signals received from additional satellites will be reflected to points outside of the focal point of the antenna and distortions will be introduced. To compensate for this distortion, more sophisticated circuitry must be used, increasing the cost of the overall system.

Shaped antennas are often used for systems which transmit and/or receive from multiple points. These antennas have a reflecting surface which has been modified to improve performance in selected environments. A typical application for shaped antennas is on the broadcast antennas carried by communications satellites. Because the broadcast signal from these satellites must be received across a wide area, e.g., the continental United States, the antennas arc shaped to produce a broadcast beam that spans many degrees with an essentially uniform signal strength. Such antennas are typically modified spherical or torroidial antennas.

Although there are a variety of shaped antennas for use in different environments, the present designs are not particularly configured to receive three separate beams from three narrowly spaced geosynchronous satellites, such as satellites spaced at ten-degree intervals. While use of a conventional reflector configuration provides adequate results, the side beams are distorted and therefore have lower signal strength and increased noise susceptibility. One remedy is to increase the dish size. However, small dishes are preferred for use in mass-marketed direct television delivery systems.

Accordingly, it would be advantageous to provide a specially shaped antenna which provides improved reception from three geosynchronous satellites that are spaced at ten-degree intervals.

It would also be advantageous if such an antenna were relatively small, e.g., on the order of 2 to 3 feet in diameter, so as to be usable in the mass-consumer market.

SUMMARY OF THE INVENTION

These and other problems are addressed by an antenna of the present invention which is configured to receiving satellite broadcasts from geosynchronous transmission sources spaced substantially 10 degrees apart. The new antenna comprises a modified offset parabolic antenna, preferably configured such that the vertex of the paraboloid is at the antenuna's rim. The surface of the reflector can be mapped to a unit circle and defined by a Zernike expansion. The values of the parameters of the Zernike expansion are selected to provide a shaped reflector surface which focuses beams from the three separate sources onto three focal points such that the gain of the antenna is maximized.

In the most preferred embodiment, the reflector has a physical height and width of between 18 and 19 inches, a generally elliptical rim which, when projected onto an x-y plane, is an ellipse having a half axis substantially from between eight to nine inches high and between 11 and 12 inches wide. The gain of such a shaped antenna at the 10 degree point is 33.9 dBi, approximately 0.3 dBi greater than that of a conventional parabolic antenna.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF THE PREFERRED EMBODIMENT(S)

Figure 1:
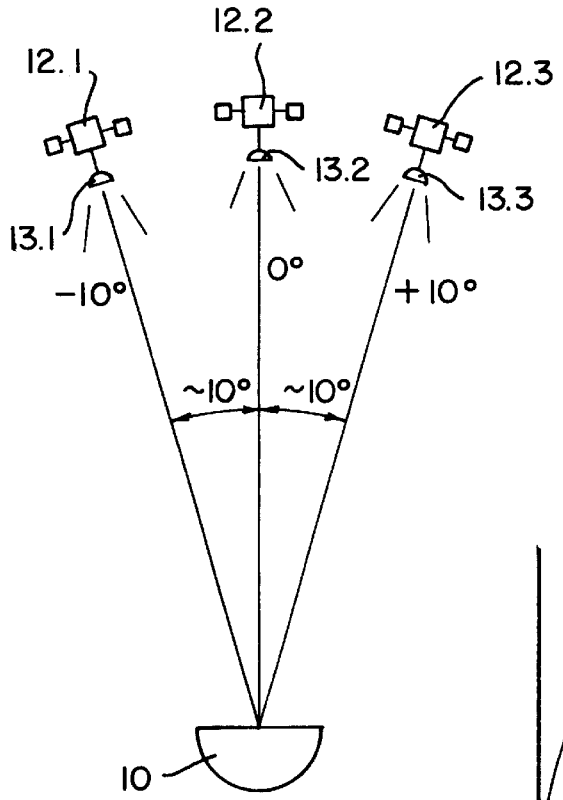
FIG. 1 is a diagram of the operating environment for the antenna according to the present invention.

Turning to FIG. 1, there is shown the operating environment for the antenna according to the present invention. The satellites are positioned across a twenty degree arc spaced ten degrees from each other. Although a variety of broadcast antennas 13.1–13.3 can be used on the satellites 12.1–12.3, in generally the antennas 13.1–13.3 will be configured to produce a beam of generally constant intensity across a wide geographic area, such as the continental United States.

When a conventional parabolic antenna is directed to a transmission source, such as a satellite, which is offset from the central axis of the antenna, the received energy will be generally focused at a point that is offset from the antenna's focal point. In addition, the energy will be somewhat distorted or smeared, such that the received energy from an offset source will be less than if the antenna was aimed directly at that source. As a result, the signal to noise ratio of the offset signal is decreased. According to the invention, a specially shaped multi-beam reflector 10 is provided which provides for increased gain for a given reflector size from three satellites spaced 10 degrees apart. More specifically, the improved antenna shape increases the strength of a signal received from a ten-degree offset source when compared to the received signal strength of a conventional parabolic or offset parabolic antenna.

The shape of a reflector antenna can be represented mathematically through the use of Zernike polynomials. As known to those of skill in the art, Zernike polynomials are complex valued functions that are useful for approximating a function within a unit circle where the equations are orthogonal and are commonly used for describing aberrations in optics and distortions in reflectors. By describing the contours of an antenna surface using Zernike polynomials, the gain and distortion of the antenna for a test signal at a given reception point, such as a focal point, can be calculated.

Briefly, an arbitrary function g (x,y) can be expanded in a Zernike series as follows:

$$G(x, y) = \sum_{m=-\infty}^{\infty} \sum_{n=|m|}^{\infty} b_{mn} V_{mn}(x, y) \qquad \text{(Equ. 1)}$$

where $V_{mn}(x,y)$ is a complex function represented in polar form by the equation:

$$Vmn(x,y)=R_{mn}(\rho)e^{jm\phi} \qquad \text{(Equ. 2),}$$

$b_{mn}$ represents the expansion coefficients, and $x=\rho\cos(\phi)$, $y=\rho\sin(\phi)$ and $R_{mn}(\rho)$ is a polynomial of the $n^{th}$ degree in $\rho$.

The value of $R_{mn}(\rho)$ can be written as:

$$R_{mn}(\rho) \sum_{s=0}^{(n-m)/2} (-1)^s \frac{(n-s)!}{s![(n+m)/2-s]![(n-m)/2-s]!} \rho^{n-2s} \qquad \text{(Equ. 3)}$$

Equation 2 can be expanded into its real and imaginary components, $Z_{mn}(x,y)$ and $U_{mn}(x,y)$, respectively, where:

$$Re[V_{mn}(x,y)]=Z_{mn}(x,y)=R_{mn}(\rho)\cos\phi$$

$$Im[V_{mn}(x,y)]=U_{mn}(x,y)=R_{mn}(\rho)\sin\phi \qquad \text{(Equs. 4a–4b)}$$

and $\rho$ and $\phi$ are the standard polar coordinates. Substituting the real and imaginary components of $V_{mn}(x,y)$ into Equ. 1 provides an expression of the Zernike series:

$$G(x, y) = \sum_{m=0}^{M} \sum_{n=m}^{N(m)} c_{mn} Z_{mn}(x, y) + d_{mn} U_{mn}(x, y) \qquad \text{(Equ. 5)}$$

where $c_{mn}$ and $d_{mn}$ are expansion coefficients. This approximation of a real function is known as a truncated Zernike series, where M is the maximum m index, and N(m) is the maximum n index for a given m. The m index runs from 0 to M. The n index runs from m to N(m) and is limited to those values where n−m is even. In general, N(m)=M, when M and m arc both even or odd. Otherwise, N(m)=M−1.

The Zernike polynomials converge within the unit circle. When these equations are applied to a specific antenna surface, the surface is mapped onto the unit circle, e.g., by dividing the antenna parameters by the antenna's mean radius. Once this has been achieved, changes to the antenna contours can be modeled, e.g., by varying the values of $c_{mn}$ and $d_{mn}$ and calculating the effect of the change.

Various software tools are available to help model the behavior of reflective antennas. For example, the "Physical Optics Reflector Shaping Program" (POS), available from TICRA, uses Zernike polynomials to represent the surface of a reflector. Once a surface has been defined, POS can evaluate the Zernike polynomials to determine the antenna's performance and to evaluate the effect of various changes to the surface of the reflector. The POS system also permits a designer to optimize an antenna shape to meet specified design criteria, such as the position of broadcast and reception points, the number and placement of feed horns, the underlying antenna geometry (spherical, torroidial, or parabolic, etc.).

POS was generally developed to help an engineer design a shaped antenna which meets particular uniform earth coverage performance requirements from a specific satellite location. Although not the primary intent of this software, it has been found that POS may also be used to model the behavior of terrestrial antennas, and this software was particularly useful in the development and modeling of the present antenna design.

As noted above, the antenna configuration for the present invention is configured to provide improved reception gain for three beams spaced 10 degrees apart while minimizing the peak of beam gain loss that would normally be incurred on beams that are shifted off the geometric center of a reflector antenna and keeping the size of the reflector below a set limit. The antenna design was developed through an iterative process, wherein an initial configuration was subsequently modified until the improved performance was achieved.

Conventional shaped antennas are typically used to transmit (or receive) across a relatively wide arc, generally more than twenty. Such shaped antennas are generally based on modifications to a torroidial or spherical reflector. In contrast, the present antenna is based on a parabolic reflector 10, and more particularly, a parabolic surface with an elliptical rim.

The rim of the preferred reflector, when projected onto the x-y plane, is an ellipse with half axis of 8.6" high and 11.875" wide. The center of the ellipse is offset from the axis of the paraboloid by half the reflector's height so that the vertex is on the edge of the reflector. The size of this projected ellipse was selected to provide a physical reflector height of 18.25". The physical width is the same as the projected width (23.75"=18.875×2). These dimensions were selected to provide an antenna which is small enough for mass-market use while being large enough to provide a relatively good signal-to-noise ratio for the received signal.

The initial parabolic surface was configured to have a focal length of 12.125". Thus, the initial surface of the reflector can be represented by the equation:

$$z=(x^2+y^2)/(4*12.125) \quad \text{(Equ. 6)}$$

In addition to selecting the initial reflector configuration, three receiving feed horns 14.1, 14.2, and 14.3 (one for each satellite in the constellation) were also placed.

Figure 2B:
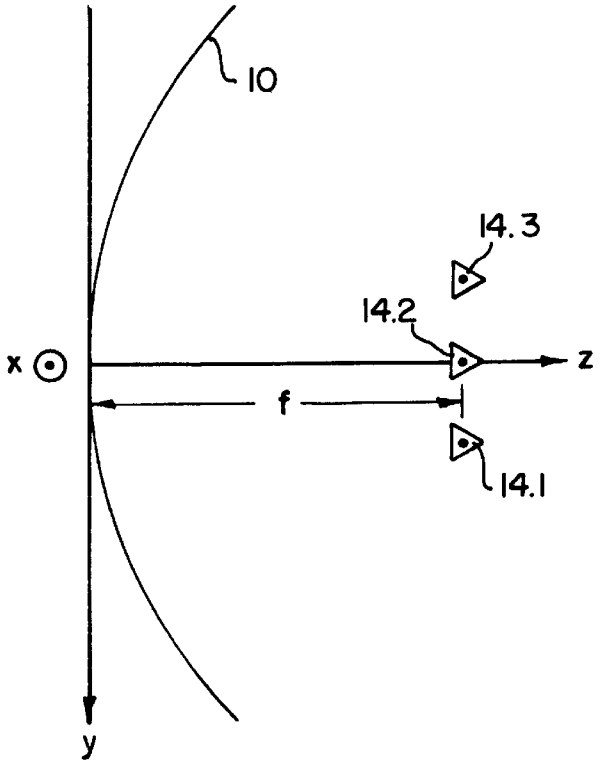
FIGS. 2*a* and 2*b* are diagrams of a receiver using a multi-beam antenna according to the invention.
Figure 2A:
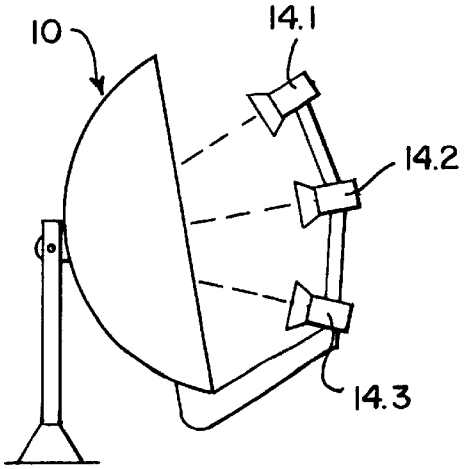

A representational diagram of a receiver using a multi-beam antenna according to the invention is shown in FIG. 2*a*. The position of the feed horns is represented graphically in FIG. 2*b*. The center feed horn 14.2 is located on the z axis a distance *f* from the reflector, where *f* is the focal length. The outer feed horns 14.1, 14.3 are displaced along the y axis. The x axis projects out of the page.

Initially, the three feeds were placed at the positions suitable for receiving three beams spaced 10 degrees apart when using a parabolic reflector. The position of the feeds was then adjusted during the shaping process, as described below. In one particular embodiment, the initial feed horn placement (in inches) along the axes was:

TABLE 1

| Feed Horn | X | Y | Z |
|---|---|---|---|
| Feed 1 (14.1) | 0.111" | 2.587" | 12.125" |
| Feed 2 (14.2) | 0 | 0 | 12.125" |
| Feed 3 (14.3) | 0.111" | −2.587" | 12.125" |

An analysis of the initial reflector indicated that to shift the main beam of the antenna by 10 degrees in azimuth, the outer feed horns had to be shifted laterally (parallel to the x-y plane) by 2.587". Further analysis revealed that an improvement in gain could be achieved by moving the offset feeds 14.1, 14.3 upwards by 0.111". In this configuration, the peak of beam gain for this 10 degree offset beam is approximately 33.6 dBi.

The shape of the reflector was then modified to provide increased gain when receiving from the particular satellite configuration at issue. Specifically, the shape of the reflector was modified to compensate for the broadening and defocusing which results from laterally shifting the feed from the focal point of the paraboloid in order to provide more than one beam from the same reflector and thereby increase the beam gain at the feeds for the offset beams.

Modifications to the shape of the reflector were introduced with the aid of the POS software. Each reflector variation was evaluated by a physical optics technique. In this technique, modeled electric fields from the feed horns are used to calculate the currents set up on the reflector. These currents are then integrated to give the field from the reflector. (The shaping of wide-beam antennas is generally done primarily using a geometric optics technique which relies upon ray-tracing. However, this technique is not sufficiently precise to model the small surface variations used in the present invention.)

The shape of the antenna was progressively modeled through several iterative cycles. In each cycle, the shape of the reflector was modified and the placement of the feed horns adjusted, as needed. In the final configuration, the peak beam gain of the offset beam was 33.9 dBi, an improvement of 0.3 dBi. The surface of the new refector can be described by the values of $c_{mn}$ and $d_{mn}$ in the Zernike polynomial of Equation 5, above. The precise values of the most preferred embodiment of the new reflector surface are listed in Table 2, below:

TABLE 2

| m | n | $c_{mn}$ | $d_{mn}$ |
|---|---|---|---|
| 0 | 0 | 2.5719437E−01 | 0.0000000E+00 |
| 0 | 2 | 1.0981317E−01 | 0.0000000E+00 |
| 0 | 4 | 2.7409926E−03 | 0.0000000E+00 |
| 0 | 6 | 9.7278653E−04 | 0.0000000E+00 |
| 0 | 8 | 7.1616451E−04 | 0.0000000E+00 |
| 0 | 10 | 3.5120874E−04 | 0.0000000E+00 |
| 1 | 1 | 3.0330770E−01 | −2.9681945E−05 |
| 1 | 3 | 3.5048199E−03 | −4.4859157E−05 |
| 1 | 5 | 1.3764300E−03 | −6.0150510E−05 |
| 1 | 7 | 1.2767802E−03 | −5.3245256E−05 |
| 1 | 9 | 8.2523236E−04 | 3.4404827E−05 |
| 2 | 2 | −6.7369407E−02 | −6.1781081E−05 |
| 2 | 4 | −3.0981488E−03 | −5.9842564E−05 |
| 2 | 6 | 4.8873004E−05 | −6.7123552E−05 |
| 2 | 8 | 1.6558888E−04 | 1.9358371E−05 |
| 2 | 10 | 2.9224180E−04 | 2.8408725E−05 |
| 3 | 3 | −7.6280140E−03 | −1.3935884E−05 |
| 3 | 5 | −1.1168235E−03 | −3.9407337E−05 |
| 3 | 7 | −8.7474096E−04 | −2.4297649E−05 |
| 3 | 9 | −1.7593086E−04 | −1.7897051E−06 |
| 4 | 4 | 3.8119123E−04 | 7.5029439E−05 |
| 4 | 6 | −9.8779143E−04 | 4.2482054E−05 |
| 4 | 8 | −1.4086510E−04 | −1.7313640E−05 |
| 4 | 10 | −3.4067100E−05 | −4.8559741E−05 |
| 5 | 5 | −1.0744727E−04 | 1.0223311E−04 |
| 5 | 7 | 6.6504070E−04 | 5.5316471E−05 |
| 5 | 9 | 1.0637857E−04 | −3.9002790E−05 |
| 6 | 6 | 1.5293410E−03 | 6.0119462E−05 |
| 6 | 8 | 2.0652483E−04 | −1.5605124E−05 |
| 7 | 7 | 1.4576642E−04 | −1.6307051E−05 |

To fabricate an antenna with the new reflector surface, these Zernike polynomial coefficients can be supplied to an appropriately configured computer aided manufacturing system which will grind or otherwise direct the fabrication of a reflector mold. Such systems are known to those of skill in the art and thus will not be described herein.

In addition to varying the initial parabolic shape provide for increased-gain beams when receiving from satellites displaced ten-degrees from the central axis, the placement of the outer feed horns was shifted. The lateral offset was changed to 2.595" and the feeds were also displaced downward by 0.142" (0.253" from the initial location). The final feed horn placement most preferred for this configuration is detailed in Table 3.

TABLE 3

| Feed Horn | X | Y | Z |
|---|---|---|---|
| Feed 1 (14.1) | −0.015" | 2.595" | 12.125" |
| Feed 2 (14.2) | −0.142" | 0 | 12.125" |
| Feed 3 (14.3) | −0.015" | −2.595" | 12.125" |

Figure 3:
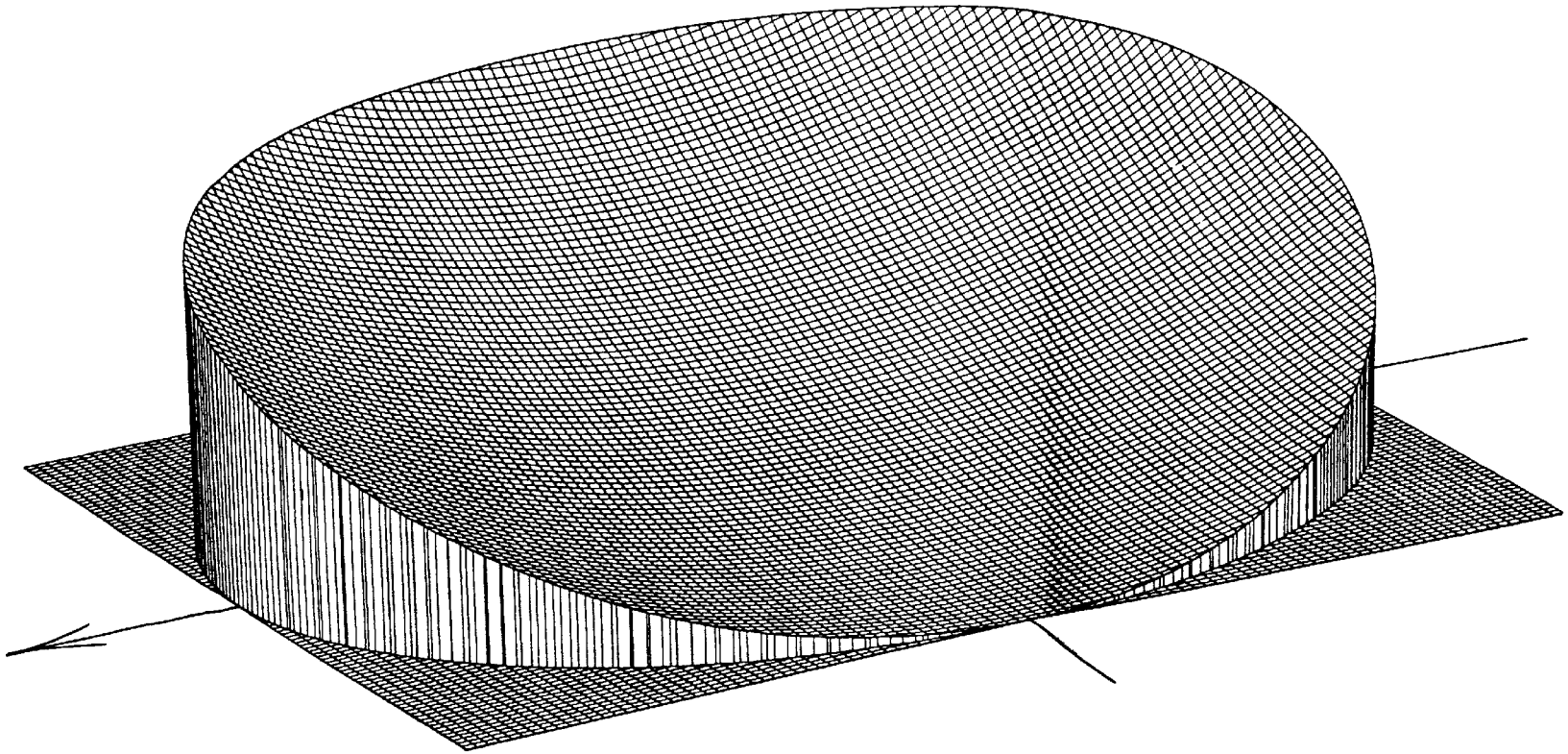
FIG. 3 is a perspective view of a three-dimensional plot of the surface of the new antenna configuration.
Figure 4:
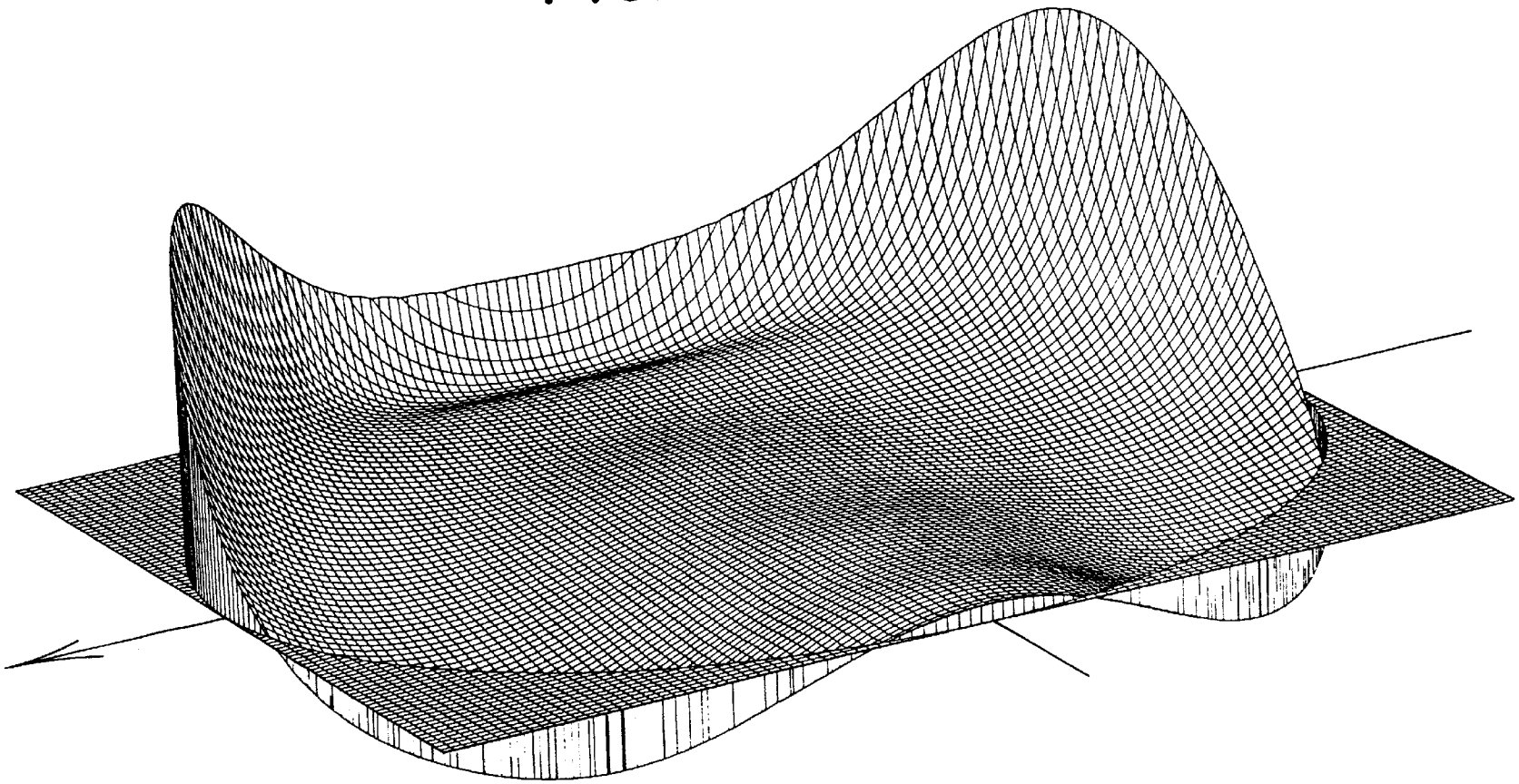
FIG. 4 is a graph of the variation of the new antenna surface configuration from parabolic.
Figure 5:
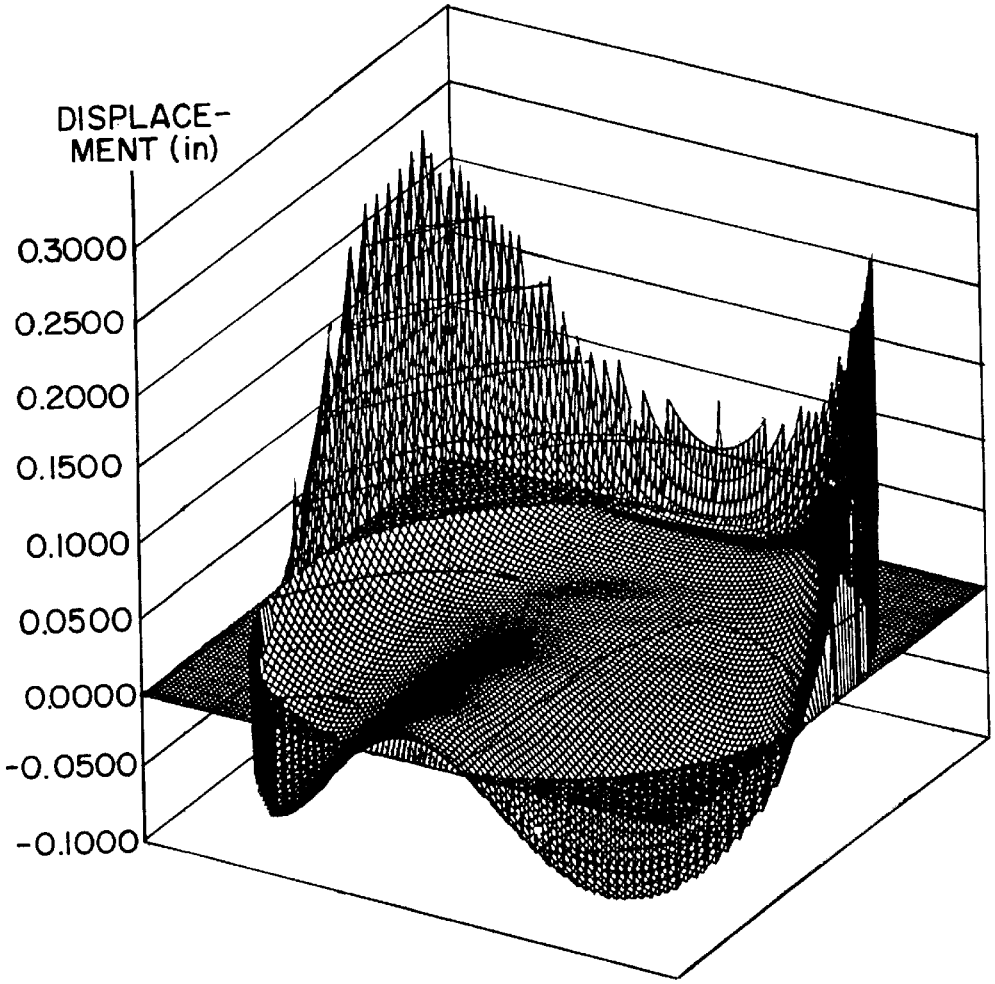
FIG. 5 is a scaled representation of the graph of FIG. 4.

Graphical representations of the modified surface of the new reflector are shown in FIGS. 3–5. Turning to FIG. 3, there is shown a three-dimensional representation of the modified reflector surface. FIG. 4 is an illustration of the difference between the new shaped surface and the initial parabolic surface. To highlight the variance of the shaped surface from parabolic, the vertical scale has been expanded by a factor of 25. The same information is presented in a somewhat different format in FIG. 5, where the elliptical rim of the reflector has been mapped onto a circle and the vertical scale is in inches. (The horizontal axes are dimensionless.) As can be seen from FIG. 5, in particular, the maximum offsets occur at the top and bottom "corners" of the reflector. The lower outer corners 20.1, 20.2 of the antenna have been flattened somewhat relative to the parabolic for an offset of about 0.085 inches The curvature of the upper corners 22.1, 22.2 has been increased such that the top corners are offset toward the focus by approximately 0.27 inches.

Figure 6:
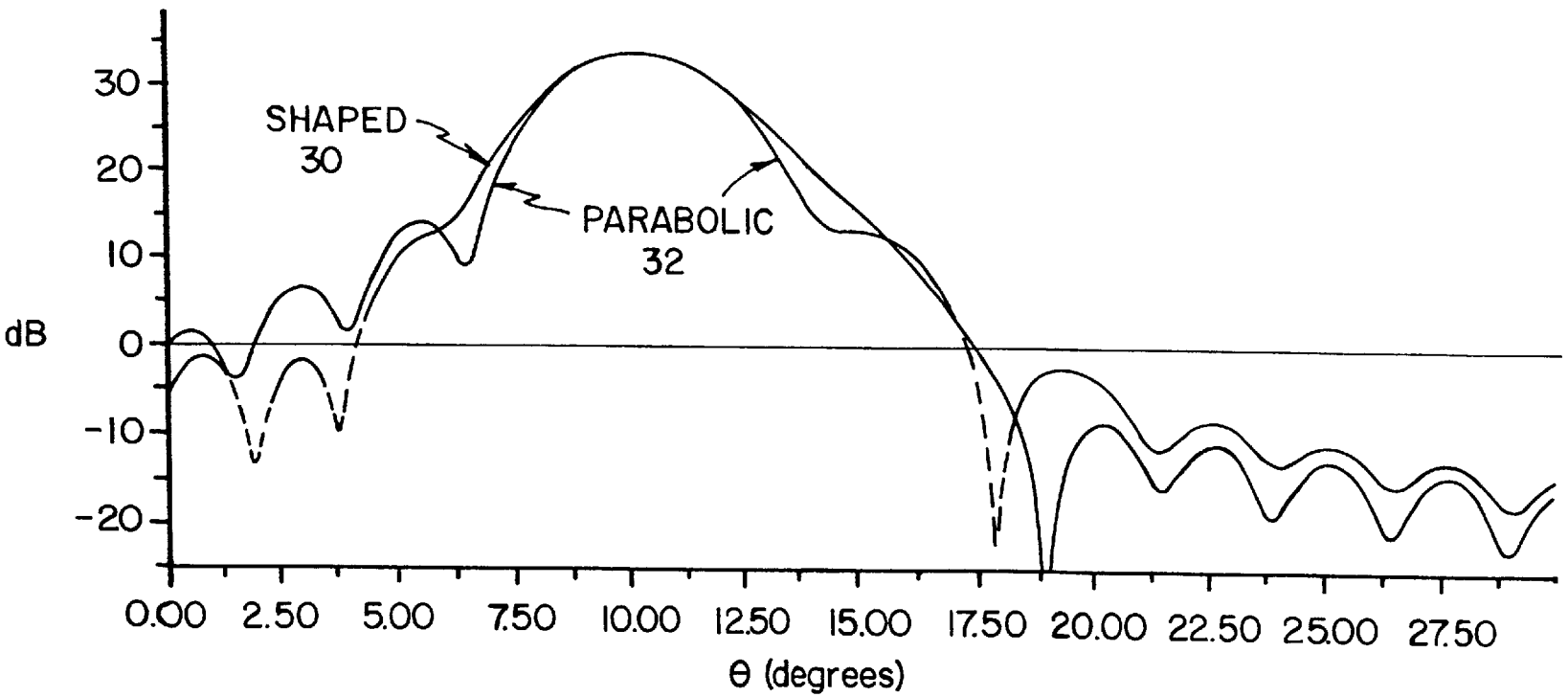
FIG. 6 is a graph of the performance of the new antenna compared with a conventional parabolic reflector.
Figure 7:
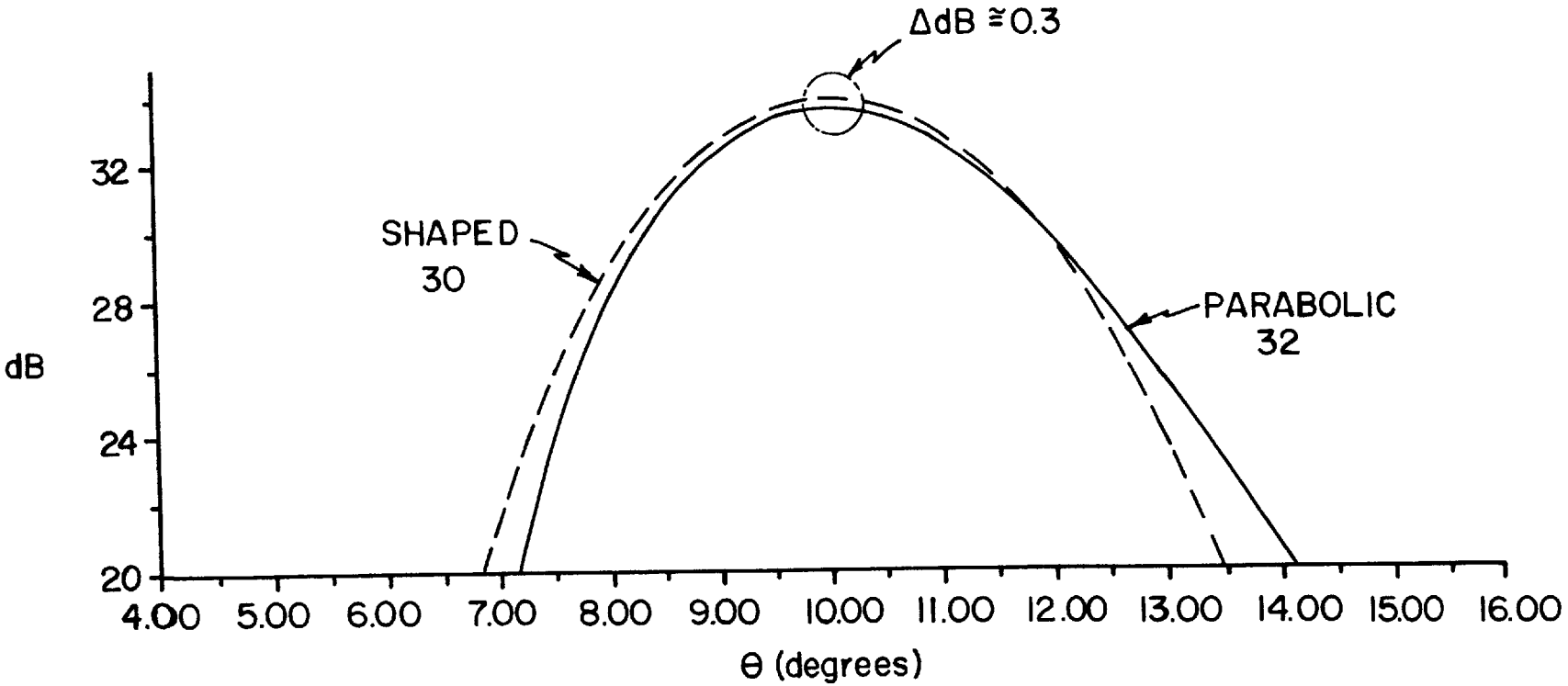
FIG. 7 is a magnified view of the graph of FIG. 6 centered at ten degrees.

FIG. 6 is a graph of the electrical performance of the new antenna compared with a conventional parabolic reflector. FIG. 7 is a magnified view of the graph of FIG. 6 centered at ten degrees showing improved electrical performance of the antenna for the offset beams compared to that of a parabolic reflector. The dashed line 30 is the pattern obtained when using the shaped reflector and the solid line 32 is the pattern obtained using the parabolic reflector. As can be seen, there is an increase in gain of about 0.3 dB at the 10 degree offset for the new antenna shape, when compared to a conventional parabolic configuration.

Advantageously, this increase in gains permits the use of less complex and expensive receiving equipment because the signal-to-noise ratio of the received signal is increased. Alternatively, for a given receiver, the new antenna will provide for increased signal clarity for the offset bands. (The gain for of the center beam is substantially the same for the new and conventional parabolic designs.)

We claim:

1. A multibeam antenna system comprising:

a modified offset parabolic antenna including a reflector;

a shape G(x,y) of the reflector, when mapped to a unit circle, is determined by the Zernike expansion:

$$G(x, y) = \sum_{m=0}^{M} \sum_{n=m}^{N(m)} c_{mn} Z_{mn}(x, y) + d_{mn} U_{mn}(x, y)$$

where $Z_{mn}(x,y)=R_{mn}(\rho)\cos\phi$, $U_{mn}(x,y)=R_{mn}(\rho)\sin\phi$, $\rho$ and $\phi$ being polar coordinates, and where $$R_{mn}(\rho) = \sum_{s=0}^{(n-m)/2} (-1)^s \frac{(n-s)!}{s![(n+m)/2-s]![(n-m)/2-s]!} \rho^{n-2s};$$

the values of the parameters $c_{mn}$ and $d_{mn}$ being selected so that the reflector surface focuses beams from three separate sources spaced substantially at −10 degrees, zero degrees, and +10 degrees along an arc onto three focal points and maximizes the gain of the multibeam antenna system for at least the beams located at +10 and −10 degrees.

2. The multibeam antenna system of claim 1, wherein:

the reflector has a height and width of between 18 and 19 inches, a generally elliptical rim which, when projected onto an x-y plane, is an ellipse having a half axis substantially from between eight to nine inches high and between 11 and 12 inches wide; and the center of the ellipse is offset from the axis of the paraboloid by half the reflector's height so that a vertex is on the rim of the reflector.

3. The multibeam antenna system of claim 2, wherein:

the projected ellipse size is 8.6" high and 11.875" wide; and the reflector height and width is 18.25".

4. The multibeam antenna system of claim 3, wherein the values of the parameters $c_{mn}$ and $d_{mn}$ for the Zernike expansion are about:

| m | n | $c_{mn}$ | $d_{mn}$ |
|---|---|---|---|
| 0 | 0 | 2.57E−01 | 0.00 |
| 0 | 2 | 1.10E−01 | 0.00 |
| 0 | 4 | 2.74E−03 | 0.00 |
| 0 | 6 | 9.73E−04 | 0.00 |
| 0 | 8 | 7.16E−04 | 0.00 |
| 0 | 10 | 3.51E−04 | 0.00 |
| 1 | 1 | 3.03E−01 | −2.97E−05 |
| 1 | 3 | 3.50E−03 | −4.49E−05 |
| 1 | 5 | 1.38E−03 | −6.02E−05 |
| 1 | 7 | 1.28E−03 | −5.32E−05 |
| 1 | 9 | 8.25E−04 | 3.44E−05 |
| 2 | 2 | −6.74E−02 | −6.18E−05 |
| 2 | 4 | −3.10E−03 | −5.98E−05 |
| 2 | 6 | 4.89E−05 | −6.71E−05 |
| 2 | 8 | 1.66E−04 | 1.94E−05 |
| 2 | 10 | 2.92E−04 | 2.84E−05 |
| 3 | 3 | −7.63E−03 | −1.39E−05 |
| 3 | 5 | −1.12E−03 | −3.94E−05 |
| 3 | 7 | −8.75E−04 | −2.43E−05 |
| 3 | 9 | −1.76E−04 | −1.79E−06 |
| 4 | 4 | 3.81E−04 | 7.50E−05 |
| 4 | 6 | −9.88E−04 | 4.25E−05 |
| 4 | 8 | −1.41E−04 | −1.73E−05 |
| 4 | 10 | −3.41E−05 | −4.86E−05 |
| 5 | 5 | −1.07E−04 | 1.022E−04 |
| 5 | 7 | 6.65E−04 | 5.53E−05 |
| 5 | 9 | 1.06E−04 | −3.90E−05 |
| 6 | 6 | 1.53E−03 | 6.01E−05 |
| 6 | 8 | 2.07E−04 | −1.56E−05 |
| 7 | 7 | 1.46E−04 | −1.63E−05. |

5. The multibeam antenna system of claim 4, wherein the values of the parameters $c_{mn}$ and $d_{mn}$ are substantially:

| m | n | $c_{mn}$ | $d_{mn}$ |
|---|---|---|---|
| 0 | 0 | 2.5719437E−01 | 0.0000000E+00 |
| 0 | 2 | 1.0981317E−01 | 0.0000000E+00 |
| 0 | 4 | 2.7409926E−03 | 0.0000000E+00 |
| 0 | 6 | 9.7278653E−04 | 0.0000000E+00 |
| 0 | 8 | 7.1616451E−04 | 0.0000000E+00 |
| 0 | 10 | 3.5120874E−04 | 0.0000000E+00 |
| 1 | 1 | 3.0330770E−01 | −2.9681945E−05 |
| 1 | 3 | 3.5048199E−03 | −4.4859157E−05 |
| 1 | 5 | 1.3764300E−03 | −6.0150510E−05 |
| 1 | 7 | 1.2767802E−03 | −5.3245256E−05 |
| 1 | 9 | 8.2523236E−04 | 3.4404827E−05 |
| 2 | 2 | −6.7369407E−02 | −6.1781081E−05 |
| 2 | 4 | −3.0981488E−03 | −5.9842564E−05 |
| 2 | 6 | 4.8873004E−05 | 6.7123552E−05 |
| 2 | 8 | 1.6558888E−04 | 1.9358371E−05 |
| 2 | 10 | 2.9224180E−04 | 2.8408725E−05 |
| 3 | 3 | −7.6280140E−03 | −1.3935884E−05 |
| 3 | 5 | −1.1168235E−03 | −3.9407337E−05 |
| 3 | 7 | −8.7474096E−04 | −2.4297649E−05 |
| 3 | 9 | −1.7593086E−04 | −1.7897051E−06 |
| 4 | 4 | 3.8119123E−04 | 7.5029439E−05 |
| 4 | 6 | −9.8779143E−04 | 4.2482054E−05 |
| 4 | 8 | −1.4086510E−04 | −1.7313640E−05 |
| 4 | 10 | −3.4067100E−05 | −4.8559741E−05 |
| 5 | 5 | −1.0744727E−04 | 1.0223311E−04 |
| 5 | 7 | 6.6504070E−04 | 5.5316471E−05 |
| 5 | 9 | 1.0637857E−04 | −3.9002790E−05 |
| 6 | 6 | 1.5293410E−03 | 6.0119462E−05 |
| 6 | 8 | 2.0652483E−04 | −1.5605124E−05 |
| 7 | 7 | 1.4576642E−04 | −1.6307051E−05. |

6. The multibeam antenna system of claim 1, wherein a peak beam gain of an offset beam is substantially 33.9 dBi.

7. The multibeam antenna system of claim 1, further comprising a feed horn positioned at each of the three focal points.

* * * * *

UNITED STATES PATENT AND TRADEMARK OFFICE

CERTIFICATE OF CORRECTION

PATENT NO. : 6,222,495 B1
DATED : April 24, 2001
INVENTOR(S) : Scott J. Cook and Bruce W. Barratt It is certified that error appears in the above-identified patent and that said Letters Patent is hereby corrected as shown below:

Title page,
Item [75], Inventor, change place of residence. "Selma" should be -- Clayton --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*